United States Patent [19]

Okamura

[11] 4,275,391

[45] Jun. 23, 1981

[54] KEY CONTROLLED, POSITION SENSITIVE, PORTABLE ALARM

[75] Inventor: Okamura, Hazime, Miyazaki, Japan

[73] Assignee: Honda Lock Mfg. Co., Ltd., Miyazaki, Japan

[21] Appl. No.: 10,489

[22] Filed: Feb. 8, 1979

[30] Foreign Application Priority Data

Apr. 3, 1978 [JP] Japan ..... 53-38636

[51] Int. Cl.[3] ..... G08B 13/14; G08B 13/08

[52] U.S. Cl. ..... 340/571; 200/61.52; 340/591; 340/547; 340/689; 200/61.45 R; 200/61.45 M

[58] Field of Search ..... 340/546, 571, 689, 547; 200/61.52, 61.45 M, 61.45 R

[56] References Cited

U.S. PATENT DOCUMENTS

| | | | |
|---|---|---|---|
| 3,261,010 | 7/1966 | Kardel | 340/546 |
| 3,548,400 | 12/1970 | Boyd et al. | 200/61.52 |
| 3,725,896 | 4/1973 | Wagner | 340/546 |
| 4,012,611 | 3/1977 | Peterson | 200/61.45 R |
| 4,030,087 | 6/1977 | Ritchie et al. | 340/571 |

*Primary Examiner*—Glen R. Swann, III

*Attorney, Agent, or Firm*—Fidelman, Wolffe & Waldron

[57] ABSTRACT

A portable alarm device senses movement of the device and actuates an alarm. A pendulum with attached magnet, set in motion by movement of the device, causes closing of alarm circuit reed switches to actuate a continuous alarm. The pendulum may be set by a control member and removable key to a hold position to prevent its oscillation or to a release position to allow its oscillation.

5 Claims, 7 Drawing Figures

KEY CONTROLLED, POSITION SENSITIVE, PORTABLE ALARM

BACKGROUND OF THE INVENTION

The present invention relates to handy alarm devices, and more particularly, to a portable type handy alarm device provided with an abnormality sensing means for the purpose of burglar-proofing.

Alarm devices heretofore available as abnormality sensing means for the purpose of burglar-proofing are activated by a change in light or electric current associated with a door or entranceway. In these devices, however, wires are extended to constitute a system, and hence, the structure becomes large-scaled and complicated and the device is expensive. In addition, these prior devices gave rise to various inconveniences in installation and resulted in a considerable increase in cost unless the system was laid out from the outset of the installation.

Furthermore, the prior art devices have suffered from disadvantages in terms of cost and the impracticality of providing separate articles with the sensing portion of alarm system.

SUMMARY OF THE INVENTION

The present invention relates to an alarm device which has been achieved as a result of various studies and developments made in an effort of solving and removing at once those disadvantages noted above with respect to the prior art alarm devices.

That is, the most significant object of the present invention resides in burglar-proofing. It is therefore a primary object of the present invention to provide a uniquely improved and extremely efficient alarm device which can continue sounding an alarm by directly and instantaneously sensing movement of an article to be protected.

It is another object of the present invention to provide an alarm device which is designed to be portable so that anybody may carry and move it, very conveniently and easily, anywhere and thereby place or set it independently in position where the article to be protected is located.

It is a further object of the present invention to provide a device which is designed to be a universal burglar-proof type alarm which is small in size and available at very low cost, which may be applied to any article to be protected and may be independently set anywhere on the article to be protected.

The above and other objects and features of the invention will appear more fully hereinafter from a consideration of the following description taken in connection with the accompanying drawings wherein preferred embodiments are illustrated by way of example.

Specific embodiments of the present invention will now be described in detail in connection with the accompanying drawings. However, features of the present invention are not limited to the illustrated embodiments but merely comprise one mode belonging to a category of the inventive concept defined in the claims of the present invention.

DESCRIPTION OF THE PREFERRED EMBODIMENTS

Figure 1:
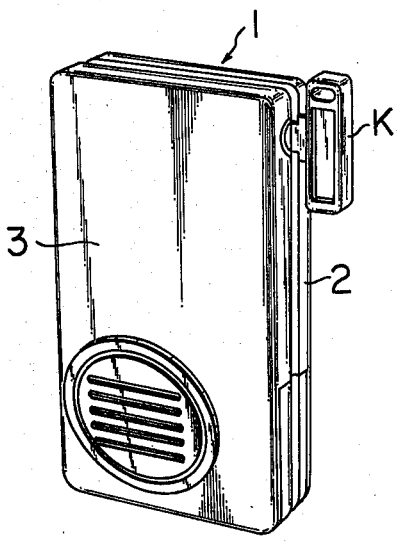
FIG. 1 is a general perspective view showing the exterior of a body of a handy alarm device in the form of a first embodiment of the present invention.

First, in FIG. 1, which is a general perspective view showing the exterior of a handy alarm device in accordance with the present invention, the body of the alarm device is designated at 1, and the reference character K denotes an operating key capable of being inserted and removed.

Figure 2:
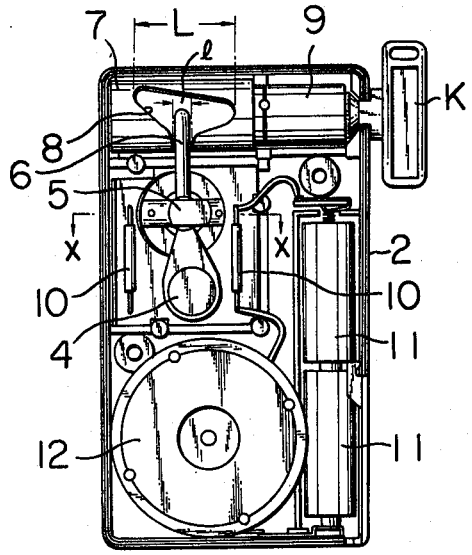
FIG. 2 is a front view of the device with a case cover of FIG. 1 removed to show the detailed construction of the interior thereof, showing a state prior to setting.

Next, FIG. 2 is a front view with a case cover 3 removed from the alarm device body 1 shown in FIG. 1 to better understand the detailed structure of the interior thereof. In this figure, the numeral 2 designates a case portion which forms one of the outer casings of the alarm device body.

Disposed in position within the case portion 2 is an oscillating member 6, which is movably supported on a supporting rod 5, having a weight and magnet 4 disposed on one end thereof; the oscillating member has the other end introduced and positioned within a substantially triangular window frame 8 bored in the peripheral surface of a cylindrical control member 7.

Figure 4:
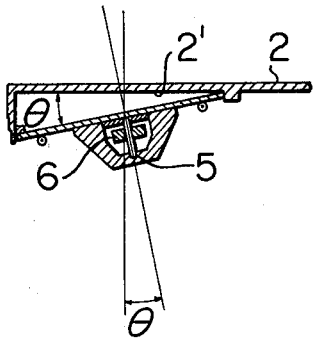
FIG. 4 is a sectional plan view taken on line X—X of FIG. 2 and as viewed in the direction of arrow.

As may be seen in FIG. 4, which is a sectional plan view taken on line X—X of FIG. 2, the oscillating member 6 is disposed with its supporting rod 5 at a suitable angle of $\theta$ relative to a back surface 2' of the case portion 2. Such a disposition senses movement of the alarm device body 1 laterally and longitudinally, that is, any movement in an instantaneous and accurate manner to provide a quick inclining motion as desired.

The control member 7 is associated with a locking inner cylinder 9 so that the former may be rotated in synchronism with the inner cylinder by operation of the key K. That is, the allowable range of oscillation of the oscillating member 6, in the state shown in FIG. 2, is limited to the width l thereof by the window frame 8 of the control member 7. However, when the key K is rotated through about 90 degrees (counterclockwise), the allowable range of oscillation is increased to the width L (as may be seen in the front view showing the operating state of FIG. 3) to release suppression of the oscillating member 6. It will be noted of course, in the position shown in FIG. 3, that the key K may be disengaged from the locking inner cylinder 9.

On the opposite sides of the oscillating member 6, there are disposed magnetically sensitive reed switches 10 as in the ilustrated embodiment, which are parallel-connected with each other and series-connected to a series circuit comprising a battery 11 and a buzzer circuit 12.

Now, even if an attempt is made to move the handy alarm device 1 of the present invention shown in FIGS. 1 and 2, which device is designed so compactly as to be capable of being carried and placed in the desired position, member 6 is positively suppressed at the l portion within the window frame 8 of the control member 7 so that the magnet 4 is not accessible to the magnetically sensitive reed switches 10. As a consequence, the reed switches are not closed, thus failing to actuate the alarm. In the state shown in FIGS. 1 and 2, key K cannot be withdrawn.

Figure 3:
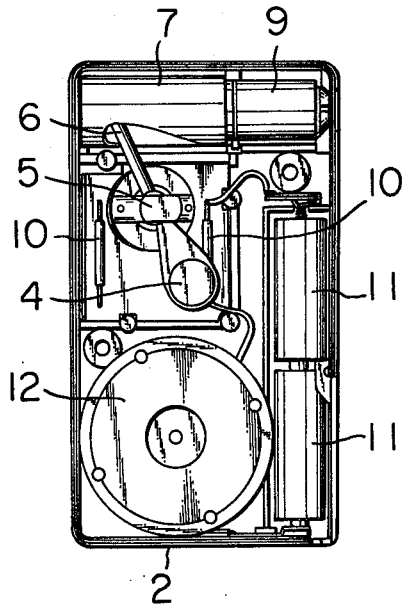
FIG. 3 is a front view showing a state of FIG. 2 after set, that is, the operating state.

Next, when the key K is rotated through about 90 degrees (counterclockwise), the oscillation-suppression of the upper end of the oscillating member 6 is released. That is, the control member is rotated by the operation of the key K, as shown in FIG. 3, so that the L portion of the window frame 8 is positioned to allow the upper end of the oscillating member 6 to be oscillatable, and the magnet 4 is accessible to either of the reed switches 10. It will be further noted, in the state shown in FIG. 3, that the key K can be withdrawn.

Figure 6:
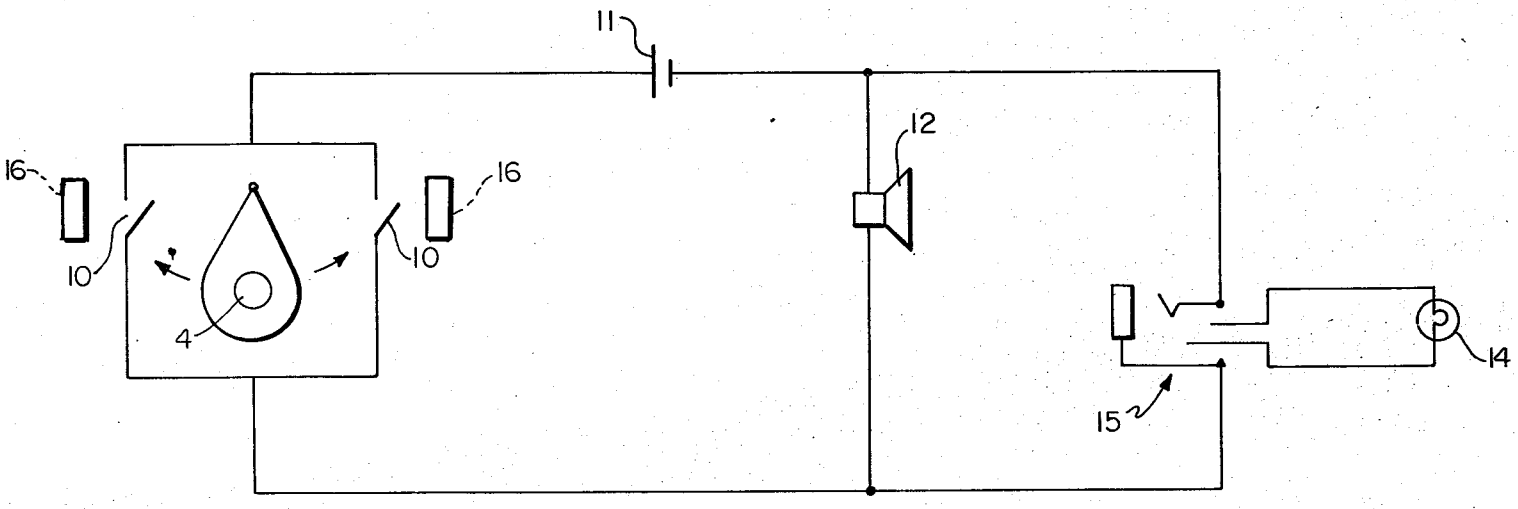
FIG. 6 is a schematic of the alarm circuit, including an auxillary attachable flashing signal.
Figure 7:
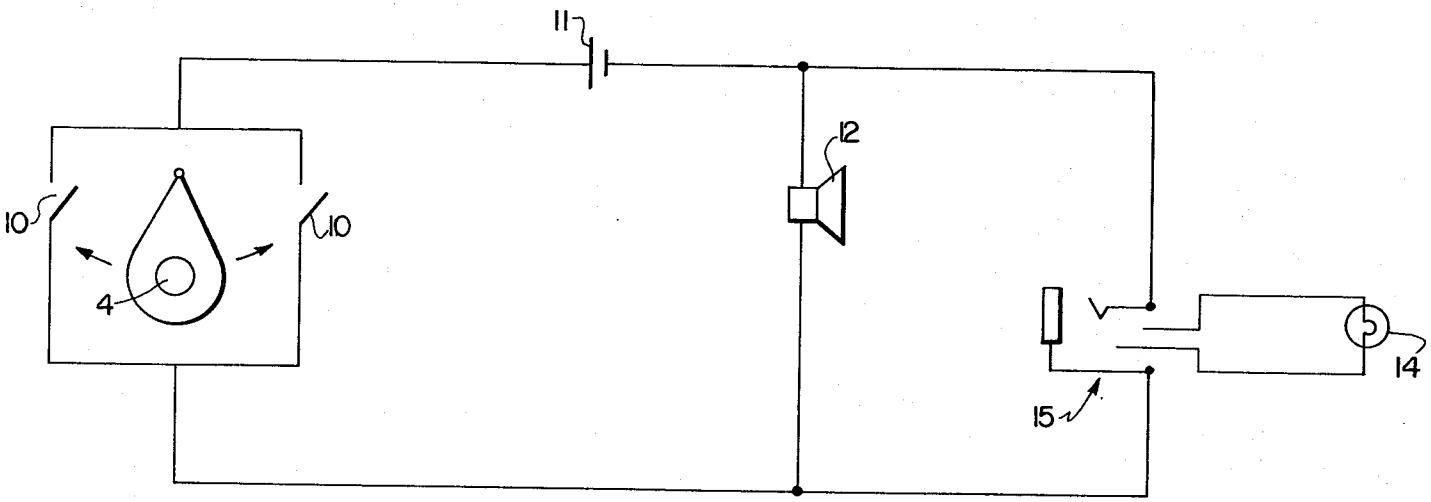
FIG. 7 is similar to FIG. 6, with the optional iron pieces removed.

Thus, the handy alarm device 1 of the present invention is laid on a suitable portion of the article to be protected to burglar-proof the article or laid in the neighborhood of a door, a window or the like; or on the floor internally of the door; and the key K is kept withdrawn. When an unauthorized person touches the article on which the handy alarm device of the present invention is laid and moves the article even a small amount, the oscillating member 6 instantaneously oscillates and the magnet 4 moves close to the reed switches 10 so that the switches provide a closed electric circuit to sound an alarm such as the buzzer 12. Iron pieces 16, as seen in FIG. 6, may be secured in the neighborhood of the reed switches 10; the magnet 4, once moved toward either side, is attracted to the piece of iron whereby the reed switches 10 are maintained closed to continue giving an alarm, thus informing a person of an invasion of an unauthorized person. Of course, iron pieces 16 could be done away with as in FIG. 7.

It is impossible to stop the alarm once it begins to sound, unless the key K is inserted into the locking inner cylinder 9 and turned clockwise. Accordingly, by turning the key K clockwise, the oscillating member 6 is pulled back along the peripheral edge of the substantially triangular window frame 8 bored in the peripheral surface of the control member 7 to return it to the position shown in FIG. 2, as a consequence, the reed switches 10 are turned OFF to stop the alarm.

As described above, the handy alarm device of the present invention, which is constructed and operated as mentioned above, is a uniquely improved and extremely efficient alarm device which can directly and instantaneously sense movement of the article to be protected. Accordingly, anybody can carry and move the present alarm device extremely easily and simply and independently lay or place it on a suitable article to be protected. In addition, the present invention alarm device is small in size and extremely low in cost and is a universal burglar-proof type device which can be independently placed for use anywhere on the article to be protected. Thus, the present invention may provide an alarm device which is extremely efficient and useful for burglar-proofing.

Figure 5:
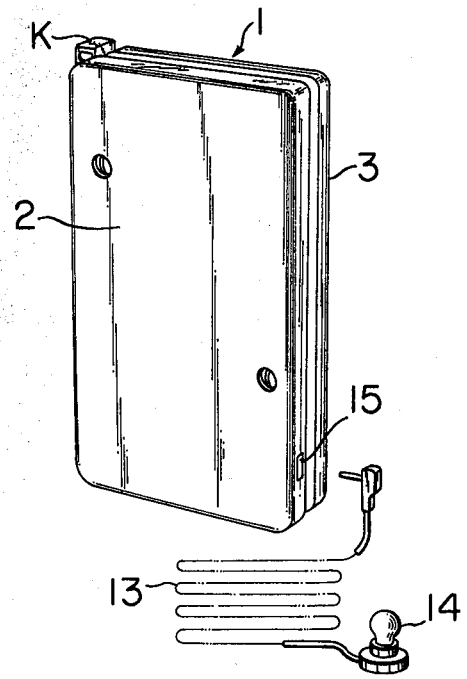
FIG. 5 is a general perspective view showing the exterior of a second embodiment of the device.

A second embodiment of the present invention, shown in FIG. 5, will be described. The second embodiment is almost the same in its object, operation and effect as those described in the first embodiment (FIGS. 1–4), except that the alarm circuit comprises an auxiliary flashing signal display 14. An outer peripheral wall of the case portion 2 of the alarm device body 1 is provided with a jack 15 for insertion therein of a flashing signal lamp 14 connected to the end of a suitable length of lead wire 13. With this arrangement, the lead wire may be connected to the jack and extended a suitable length so that the flashing signal lamp 14 may be set adjacent the user to provide two alarms, a buzzer and flashing signal display. In this manner, two alarm means (of the so-called auditory and visual senses) are provided by which it is possible to instantaneously and accurately detect an invader or unauthorized person.

What is claimed is:

1. A portable alarm device comprising:

a moveable magnet in a case;

a control member settable to a hold position or a release position for respectively preventing or allowing movement of said magnet in response to movement of said case;

a locking cylinder rotatable in synchronism with said control member and actuatable to set said control member to said hold position or said release position;

an alarm circuit having magnetically sensitive switches closeable by movement of said magnet to actuate an alarm when said control member is set to said release position and said magnet moves; and a removable key adapted to actuate said locking cylinder.

2. An apparatus as in claim 1, wherein said portable alarm device further comprises a pendulum having a first end, a second end, and a suspension point, said pendulum supported at said suspension point by a support rod, said magnet disposed on said first end of said pendulum to act as a weight, said support rod attached to a wall of said case at a suitable angle to allow swinging of said pendulum, and said second end of said pendulum introduced and positioned in a substantially triangular window frame formed in said control member, whereby said pendulum may oscillate within said case about said suspension point when said control member is set to said release position.

3. An apparatus as in claim 1, wherein said alarm circuit includes a buzzer.

4. An apparatus as in claim 1, wherein said alarm circuit includes a flashing signal display.

5. An apparatus as in claim 1, wherein said alarm of said alarm circuit includes a buzzer and a flashing signal display.

* * * * *